US008925453B2

(12) United States Patent
Kusaka

(10) Patent No.: US 8,925,453 B2
(45) Date of Patent: Jan. 6, 2015

(54) INTAGLIO PRINTING PRESS

(75) Inventor: Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 266 days.

(21) Appl. No.: 12/782,022

(22) Filed: May 18, 2010

(65) Prior Publication Data

US 2010/0294149 A1 Nov. 25, 2010

(30) Foreign Application Priority Data

May 19, 2009 (JP) ..... 2009-120443

(51) Int. Cl.

| | |
|---|---|
| ***B41F 9/02*** | (2006.01) |
| ***B41F 35/00*** | (2006.01) |
| ***B41F 33/04*** | (2006.01) |
| ***B41F 31/30*** | (2006.01) |
| ***B41F 31/26*** | (2006.01) |
| ***B41F 33/00*** | (2006.01) |
| ***B41F 35/04*** | (2006.01) |

(52) U.S. Cl.

CPC ..... *B41F 31/302* (2013.01); *B41F 9/021* (2013.01); *B41F 31/26* (2013.01); *B41F 31/30* (2013.01); *B41F 33/0018* (2013.01); *B41F 35/04* (2013.01); *B41P 2213/71* (2013.01)

USPC ..... 101/153; 101/152; 101/480

(58) Field of Classification Search

USPC ..... 101/150, 151, 152, 153, 480

IPC ..... B41F 9/00,9/02, 9/18, 31/30

See application file for complete search history.

(56) References Cited

U.S. PATENT DOCUMENTS

| | | | | |
|---|---|---|---|---|
| 3,498,217 | A | 3/1970 | Kletti | |
| 4,765,240 | A * | 8/1988 | Kraus et al. | 101/216 |
| 5,062,359 | A * | 11/1991 | Giori | 101/152 |
| 5,062,360 | A * | 11/1991 | Germann et al. | 101/152 |
| 5,438,925 | A * | 8/1995 | Ohmi et al. | 101/212 |
| 6,272,987 | B1 * | 8/2001 | Kamoda | 101/153 |
| 7,011,020 | B2 * | 3/2006 | Dünninger et al. | 101/152 |

(Continued)

FOREIGN PATENT DOCUMENTS

| | | |
|---|---|---|
| EP | 0 047 909 A1 | 3/1982 |
| EP | 0 053 226 A1 | 6/1982 |

(Continued)

OTHER PUBLICATIONS

Japanese Office Action issued in Japanese Patent Application No. 2009-120443 on Jul. 2, 2013.

(Continued)

*Primary Examiner* — Leslie J Evanisko

(74) *Attorney, Agent, or Firm* — Birch, Stewart, Kolasch & Birch, LLP

(57) ABSTRACT

An intaglio printing press includes: an intaglio cylinder; an ink collecting cylinder which has a blanket attached to a circumferential surface of the collecting cylinder, is in contact with the intaglio cylinder, and transfers ink onto the intaglio cylinder; multiple chablon rollers which are in contact with the ink collecting cylinder and transfer ink onto the ink collecting cylinder; and an inking device which feeds ink to the chablon rollers. In the intaglio printing press, a work space is formed between the chablon roller located at the highest position and the chablon roller immediately below the highest chablon roller. The work space allows an access to the ink collecting cylinder without detachment of the chablon rollers.

3 Claims, 7 Drawing Sheets

(56) References Cited

U.S. PATENT DOCUMENTS

| | | | | |
|---|---|---|---|---|
| 2003/0010233 | A1* | 1/2003 | Schaede | 101/153 |
| 2007/0012207 | A1* | 1/2007 | Takenouchi et al. | 101/335 |
| 2007/0181016 | A1* | 8/2007 | Schaede | 101/152 |
| 2008/0295724 | A1* | 12/2008 | Lohweg et al. | 101/484 |

FOREIGN PATENT DOCUMENTS

| | | | |
|---|---|---|---|
| EP | 0 155 351 | A2 | 9/1985 |
| EP | 0 406 157 | A1 | 1/1991 |
| EP | 0 982 125 | A2 | 3/2000 |
| EP | 1 491 337 | A1 | 12/2004 |
| EP | 1 602 483 | A1 | 12/2005 |
| EP | 1 995 062 | A1 | 11/2008 |
| JP | 63-125336 | A | 5/1988 |
| JP | 03-038347 | A | 2/1991 |
| JP | 10-291297 | A | 11/1998 |
| JP | 2000-127349 | A | 5/2000 |
| JP | 2003-127321 | A | 5/2003 |
| JP | 2006-167922 | A | 6/2006 |
| WO | WO 01/54904 | A1 | 8/2001 |
| WO | WO 03/047862 | A1 | 6/2003 |

OTHER PUBLICATIONS

Extended European Search Report Dated Oct. 28, 2011.
Observations submitted by a third party dated Aug. 23, 2011—Form 1139.

* cited by examiner

INTAGLIO PRINTING PRESS

FIELD OF THE INVENTION

The present invention relates to an intaglio printing press and more specifically, to an intaglio printing press including a collecting cylinder having multiple rotating parts disposed therearound. Here, examples of the rotating parts include a chablon roller, an ink form roller having a pattern allowing adhesion of ink to a specific area of an intaglio printing plate, and the like.

DESCRIPTION OF THE RELATED ART

Patent Literature 1 discloses an intaglio printing press of this kind for example. In this intaglio printing press, for example when a circumferential surface of a collecting cylinder (collector inking cylinder) is to be cleaned or when a blanket attached to the circumferential surface of the collecting cylinder is to be replaced, a space to allow an access to the collecting cylinder (a work space for the collecting cylinder) is secured by detaching at least one of chablon rollers (color-selector cylinders; rotating parts) from a main frame (main structure) and then by reattaching (moving) the chablon roller to an inker frame (inking carriage).

CITATION LIST

Patent Literature 1
Japanese Patent Application Publication No. Hei 10-291297

SUMMARY OF INVENTION

Technical Problems

However, the intaglio printing press disclosed in Patent Literature 1 has a problem as below. Specifically, the chablon roller is attached and detached every time maintenance, such as cleaning and replacement of the blanket, for the collecting cylinder, is performed. Since the chablon roller is a heavy object (e.g., 300 kg/1 roller), the attachment and detachment have to be performed while the chablon roller is hung by a crane or the like. Moreover, the attachment requires adjustment of the contact pressure against the collecting cylinder. Hence, there is required troublesome and time-consuming work.

In addition, it is a large burden on the operator, and lowers productivity significantly, to attach and detach the chablon roller at occasions other than maintenance of the chablon roller itself, i.e., at every cleaning and replacement of the blanket for the collecting cylinder, which are performed frequently (e.g., the cleaning is once or twice a day and the replacement of the blanket is once a week).

Moreover, a machine structure to allow the chablon roller to be detached from the main frame (main structure) and to be reattached (moved) to the inker frame (inking carriage) is complicated. Hence, there is a problem of causing a cost increase.

To solve these problems, the present invention has an object to provide an intaglio printing press which allows an access to a collecting cylinder without having to attach and detach a rotating part such as a chablon roller and thus facilitates maintenance work for the collecting cylinder such as cleaning work for the collecting cylinder and replacement work for a blanket.

Solution to Problems

An intaglio printing press according to the present invention for achieving the object described above includes: an intaglio cylinder; a collecting cylinder which has a blanket attached to a circumferential surface of the collecting cylinder, is in contact with the intaglio cylinder, and transfers ink onto the intaglio cylinder; multiple rotating parts which are in contact with the collecting cylinder and transfer ink onto the collecting cylinder; and an ink feeding unit which feeds ink to the rotating parts. In the intaglio printing press, the multiple rotating parts are arranged in such a manner that a work space is formed between adjacent ones of the rotating parts, the work space allowing an access to the collecting cylinder without detachment of the rotating parts.

Further, the intaglio printing press includes: a first frame which rotatably supports the collecting cylinder and the rotating parts; and a second frame which supports the ink feeding unit, is supported movably, and allows the ink feeding unit to move in approaching and separating directions with respect to the rotating parts. The access to the collecting cylinder is allowed through the work space from a space formed between the ink feeding unit and the rotating parts.

Further, in the intaglio printing press, the number of the rotating parts provided is at least five.

Further, in the intaglio printing press, one of the adjacent rotating parts forming the work space is a rotating part located at the highest position.

Further, in the intaglio printing press, the rotating parts are arranged in such a manner that an interval between the rotating part located at the highest position and the rotating part immediately below the highest rotating part is larger than an interval between other adjacent ones of the rotating parts.

Further, in the intaglio printing press, a liftable step is placed in the space.

Further, in the intaglio printing press, in the work space, a safety bar is provided which is located near a point where the collecting cylinder and any of the rotating parts is in contact with each other, and which extends in an axial direction of the collecting cylinder.

Further, in the intaglio printing press, a main-unit inching switch, a main-unit reverse inching switch, and a main-unit adjusting switch are provided on a main-unit frame located at a lateral side of the work space, the main-unit adjusting switch allowing switch operations of the main-unit inching switch and the main-unit reverse inching switch.

Advantageous Effects of Invention

The intaglio printing press according to the present invention allows an access to a collecting cylinder by using a work space formed between two adjacent rotating parts such as chablon rollers, without having to attach and detach the rotating parts at the time of maintenance such as cleaning work for the collecting cylinder or replacement work for a blanket. Hence, the maintenance work for the collecting cylinder can be performed easily.

Thus, the maintenance work takes a shorter period of time, which in turn reduces the load on the operator and suppresses a decrease in productivity. Further, since a simple machine structure can be achieved by changing the arrangement of the rotating parts, a cost reduction is possible.

DETAILED DESCRIPTION OF THE INVENTION

Hereinbelow, an intaglio printing press according to the present invention will be described in detail through examples by using the drawings.

First Example

Figure 1:
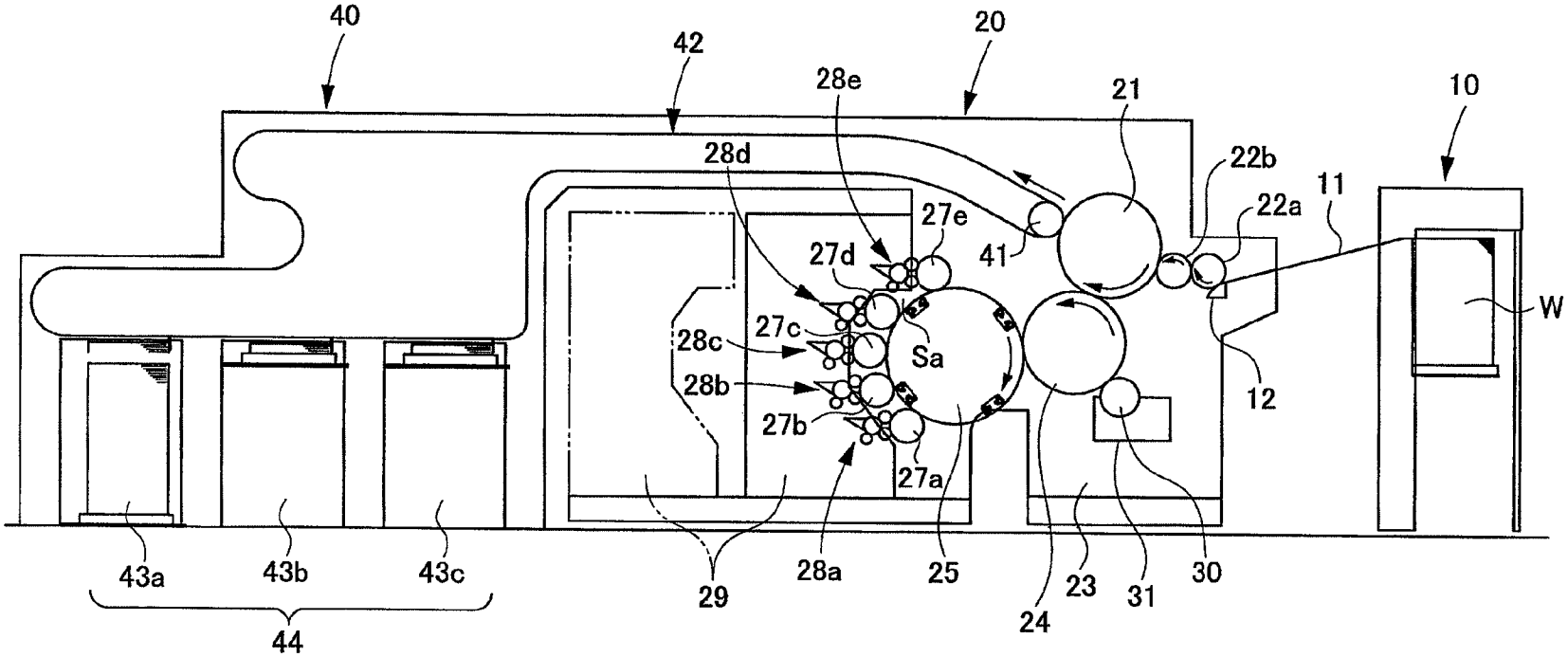
FIG. 1 is an overall configuration diagram of an intaglio printing press showing a first example of the present invention.
Figure 2:
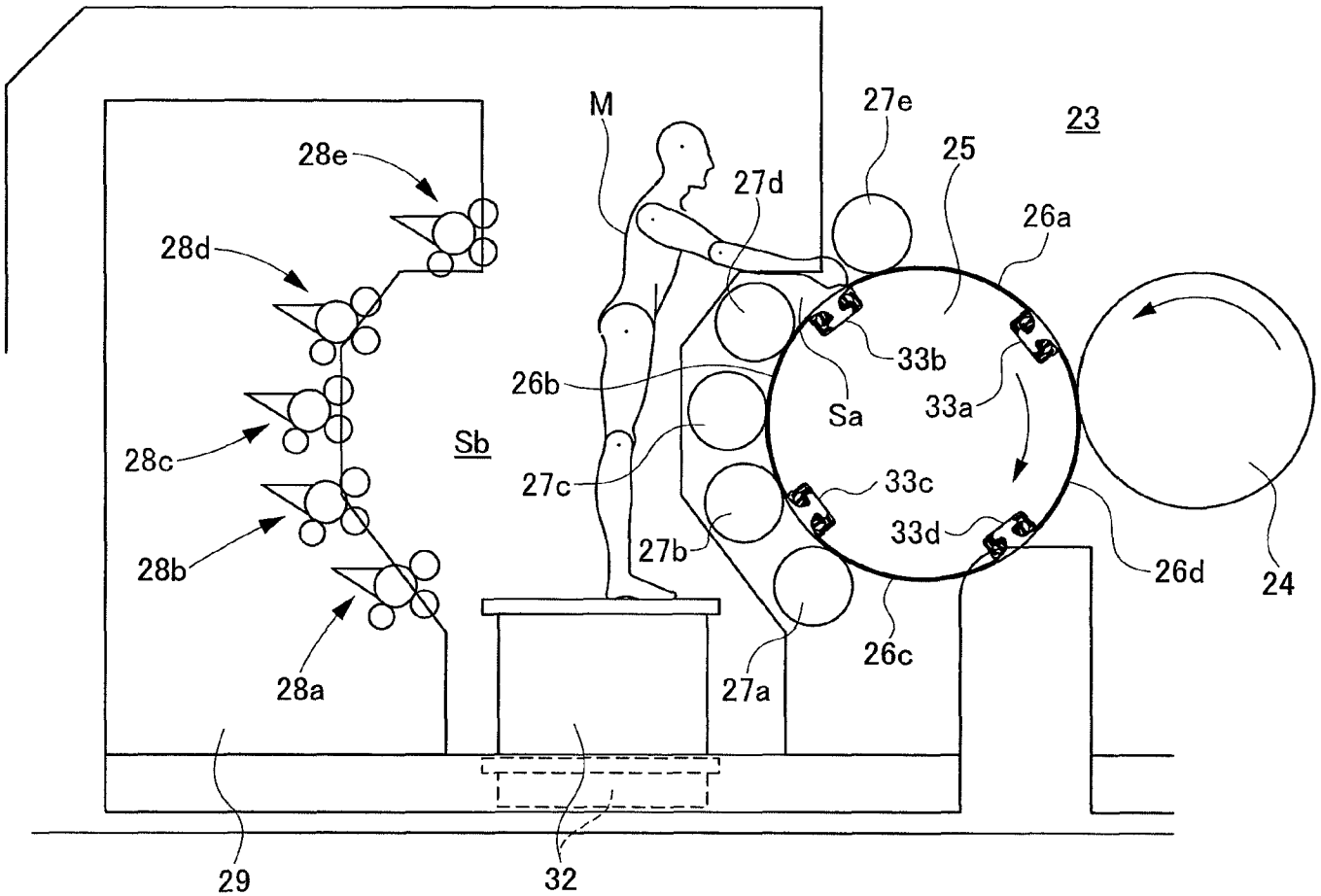
FIG. 2 is an enlarged view of a main part of a printing apparatus showing when maintenance is performed on a collecting cylinder.
Figure 3:
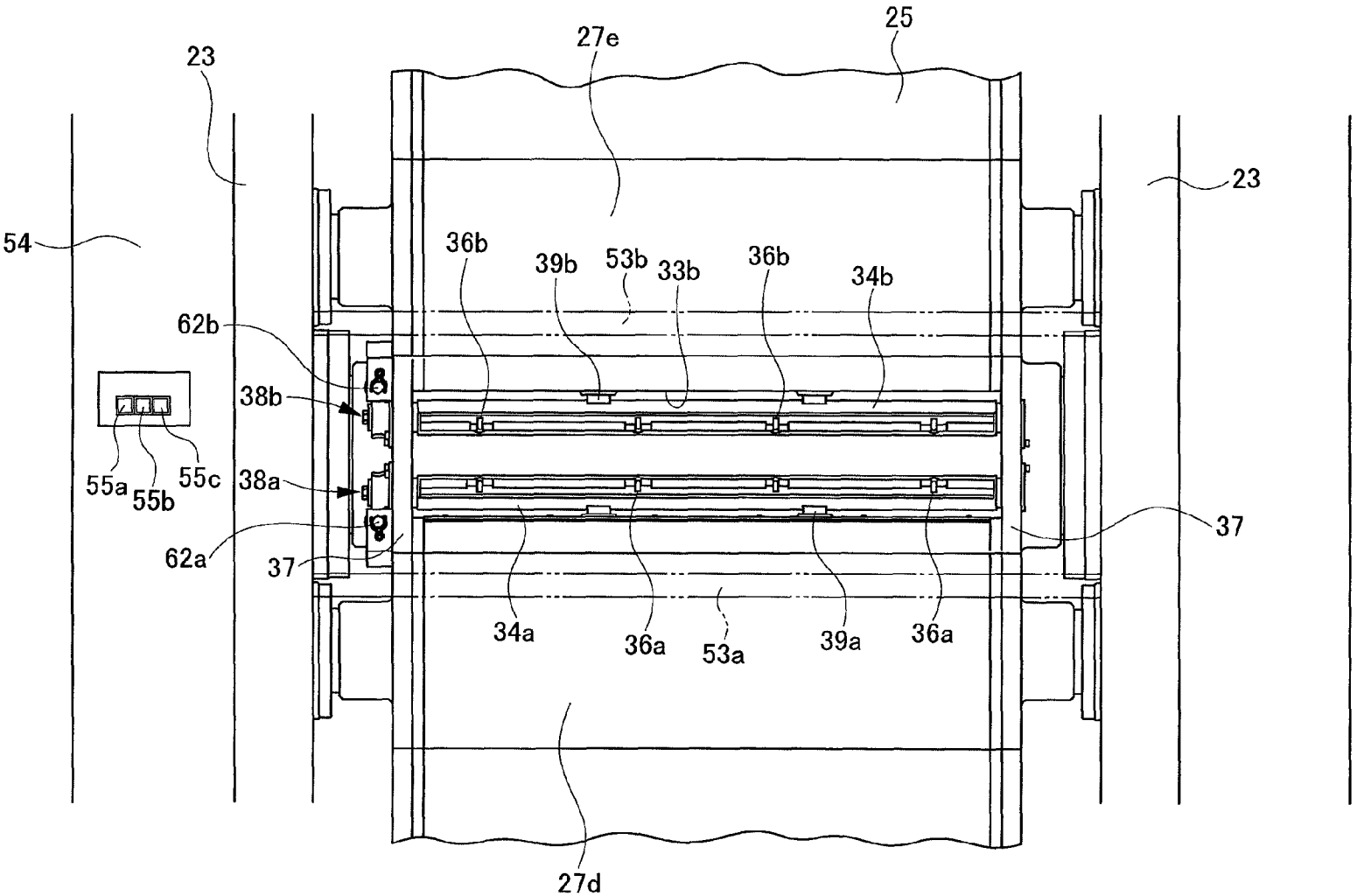
FIG. 3 is a view on an arrow A in FIG. 4 showing a work space.
Figure 4:
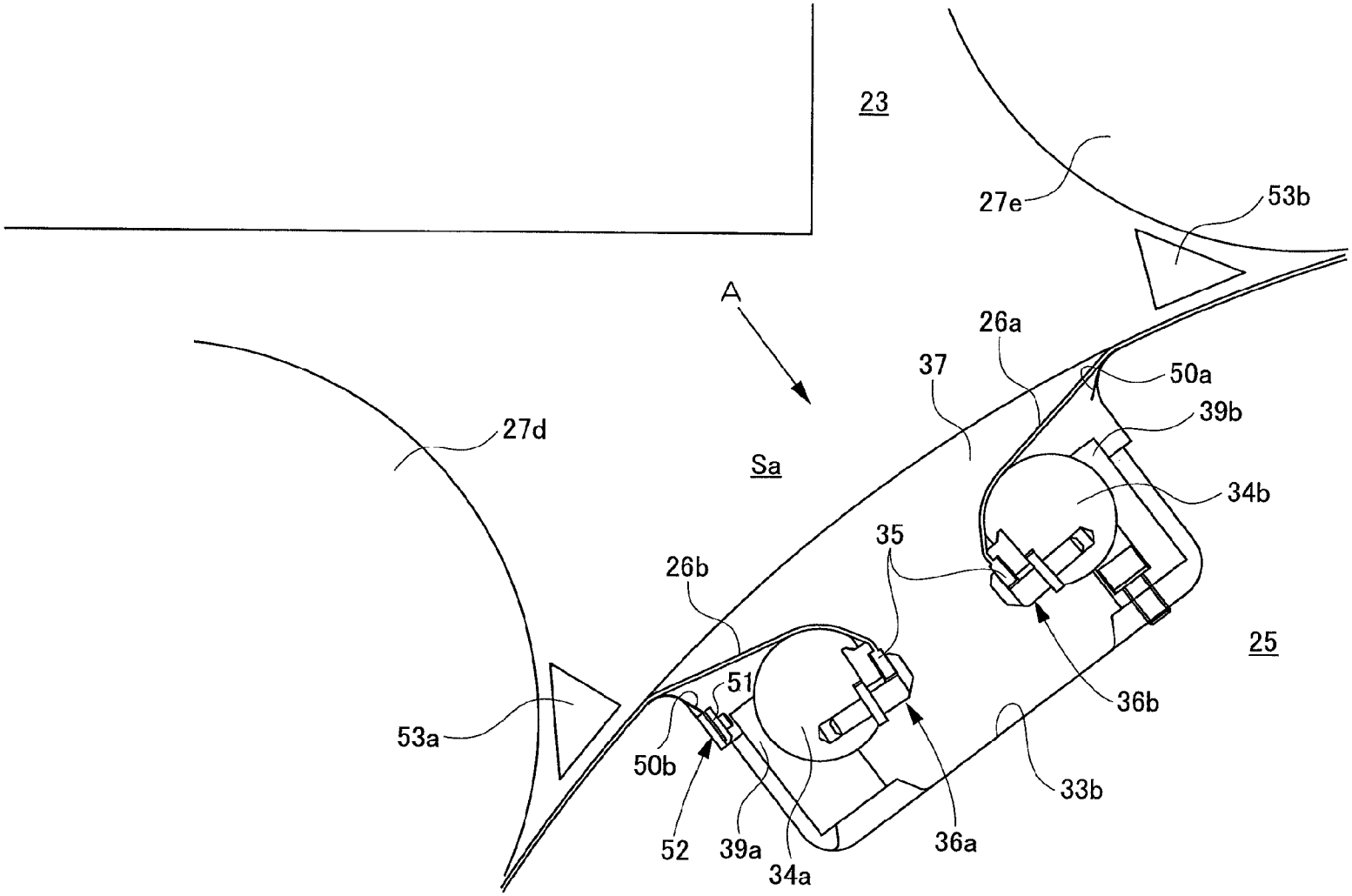
FIG. 4 is a view for explaining the work space and a notched portion of the collecting cylinder.

FIG. 1 is an overall configuration diagram of an intaglio printing press showing a first example of the present invention. FIG. 2 is an enlarged view of a main part of a printing apparatus showing when maintenance is performed on a collecting cylinder. FIG. 3 is a view on an arrow A in FIG. 4 showing a work space. FIG. 4 is a view for explaining the work space and a notched portion of the collecting cylinder.

As shown in FIG. 1, the intaglio printing press is basically formed of: a sheet feeding apparatus 10 that serves as an apparatus for feeding sheet-shaped objects; a printing apparatus 20 that performs intaglio printing on sheet-shaped objects; and a sheet discharging apparatus 40 that serves as an apparatus for discharging sheet-shaped objects.

The sheet feeding apparatus 10, in which sheets W as sheet-shaped objects are piled up, communicates with a feeder board 11 which transports the sheets W fed out individually from the top layer of the pile by a suction mechanism as a feeding mechanism of the sheet feeding apparatus 10. The feeder board 11 is provided with a swing arm shaft pregripper 12 which is held swingably and grips the sheet W on the feeder board 11.

In the printing apparatus 20, the swing arm shaft pregripper 12 communicates, via transfer cylinders 22*a* and 22*b*, with an impression cylinder 21 which is what is called a triple-size cylinder on which three grippers (not shown) are arranged at an equal interval in the circumferential direction as holding units to hold the sheet W. The impression cylinder 21 is supported by main frames (first frame) 23. The transfer cylinders 22*a* and 22*b* are provided with grippers similar to the grippers of the impression cylinder 21. These grippers enable a gripping change of a gripped sheet W from the swing arm shaft pregripper 12 to the grippers of the impression cylinder 21.

The impression cylinder 21 is in contact with a plate cylinder 24. The plate cylinder 24 is what is called a triple-size cylinder to which three intaglio printing plates can be attached in the circumferential direction, and is supported by the main frames 23. The intaglio printing plates of the plate cylinder 24 are in contact with an ink collecting cylinder (collecting cylinder) 25. The ink collecting cylinder 25 is what is called quadruple-size cylinder to which four rubber blankets 26*a* to 26*d* (see FIG. 2) can be attached in the circumferential direction, and is supported by the main frames 23.

The ink collecting cylinder 25 is in contact with five chablon rollers (rotating parts) 27*a* to 27*e* arranged in the circumferential direction. The chablon rollers 27*a* to 27*e* each have a circumferential-surface length corresponding to the lengths of a blanket of the impression cylinder 21 and the intaglio printing plates of the plate cylinder 24, and are supported by the main frames 23. The chablon rollers 27*a* to 27*e* are in contact with inking devices (ink feeding units) 28*a* to 28*e*, respectively. The inking devices 28*a* to 28*e* feed inks to the chablon rollers 27*a* to 27*e*, respectively, and are supported by an inker frame (second frame) 29 (see FIG. 2). The inking devices 28*a* to 28*e* are filled with inks of mutually different colors, respectively.

The inker frame 29 is supported movably in an approaching/separating direction (a lateral direction in FIG. 1) with respect to a chablon roller support of each main frame 23. Specifically, the inker frame 29 is supported in such a movable manner that it can move between an ink feeding position (see a solid line position in FIG. 1) and a separated position (see a two-dot chain line position in FIG. 1 and a solid line position in FIG. 2). The ink feeding position is where the inking devices 28*a* to 28*e* are in contact with the chablon rollers 27*a* to 27*e* and transfer their inks to the chablon rollers 27*a* to 27*e*. The separated position is where the inking devices 28*a* to 28*e* are separated from the chablon rollers 27*a* to 27*e*.

The intaglio printing plates of the plate cylinder 24 are in contact with a wiping roller 30. This wiping roller 30 is soaked in a solvent pooled in a wiping tank 31.

In the sheet discharging apparatus 40, a sheet discharging cylinder 41 is in contact with the impression cylinder 21. A pair of unillustrated sprockets constituting this sheet discharging cylinder 41 have a sheet discharging chain 42 endlessly wound therearound. On a downstream side of the sheet discharging chain 42 in the direction of travel, there is disposed a delivery unit 44 in which three delivery piles 43*a* to 43*c* are aligned. Meanwhile, unillustrated gripper units are provided to the sheet discharging chain 42 at a certain interval.

In the first example, a work space Sa is formed between two adjacent ones of the chablon rollers 27*a* to 27*e* as shown in FIG. 2. The work space Sa allows an access to the ink collecting cylinder 25 without having to detach the chablon rollers 27*a* to 27*e* at the time of maintenance such as cleaning work for the ink collecting cylinder 25 or replacement work for the blankets.

In the illustrated example, the chablon rollers 27*a* to 27*e* are arranged in such a manner that the interval between the chablon roller 27*e*, which is located at the highest position among the five chablon rollers 27*a* to 27*e*, and the chablon roller 27*d* immediately below the chablon roller 27*e* is larger than the interval between any other two adjacent chablon rollers. When the inker frame 29 is at the separated position shown in FIG. 2 and an operator M is located in a space Sb formed between the inking devices 28*a* to 28*e* and the chablon rollers 27*a* to 27*e*, the operator M can access to the ink collecting cylinder 25 through the work space Sa. That is, an access to the ink collecting cylinder 25 is allowed from the space Sb, formed between the inking devices 28*a* to 28*e* and the chablon rollers 27*a* to 27*e*, and through the work space Sa.

In addition, a liftable (retractable) step 32 is placed in the space Sb. This step 32 is supported movably upward and downward between a stored position (see a chain line position in FIG. 2) and a work position (see a solid line position in FIG. 2). The stored position is where the step 32 is stored in such a manner as not to hinder the movement of the inker frame 29. The work position is where the step 32 is lifted from the stored position and the operator M gets on the step 32 to perform operations. The step 32 is placed at the stored position at the time of printing, whereas the step 32 is placed at the work position at the time of performing maintenance work, such as cleaning work for the ink collecting cylinder 25 or replacement work for the blankets, through the work space Sa. Note that the step 32 is not limited to a liftable (retractable) step as above, and may be one without the lifting function. In that case, the step 32 is moved in and out of the space Sb (the inside of the apparatus).

In a case of replacement work for the blankets of the ink collecting cylinder 25, the work is performed while operating a leading edge winding shaft 34*a* and a trailing edge winding shaft 34*b* accommodated in each of four notches (gaps) 33*a* to 33*d* formed in an circumferential surface of the ink collecting cylinder 25 at an equal interval as shown in FIGS. 3 and 4.

Specifically, bars 35 attached to both end portions of each of the blankets 26*a* to 26*d* are made detachably attachable to blanket holding means 36*a* and 36*b* provided in plurality (four in the illustrated example) in the axial direction of the leading edge winding shaft 34*a* and the trailing edge winding shaft 34*b*. Both end portions of each of the leading edge winding shaft 34*a* and the trailing edge winding shaft 34*b* are rotatably supported between paired right and left bearers 37 of the ink collecting cylinder 25. One end portions of the leading edge winding shaft 34*a* and the trailing edge winding shaft 34*b* which protrude outside the bearer 37 are provided with worm gears 38*a* and 38*b*, respectively. By operating operation portions 62*a* and 62*b* of the respective worm gears 38*a* and 38*b* with a tool such as a spanner, the leading edge winding shaft 34*a* and the trailing edge winding shaft 34*b* can be rotated in a certain direction (tightening direction or loosening direction).

Note that in FIGS. 3 and 4, 39*a* and 39*b* represent supports to rotatably support the leading edge winding shaft 34*a* and the trailing edge winding shaft 34*b* at two positions in the longitudinal direction inside the corresponding one of the notches (gaps) 33*a* to 33*d*. 53*a* and 53*b* represent safety bars which are located near the points where the ink collecting cylinder 25 and the respective chablon rollers 27*d* and 27*e* are in contact with each other in the work space Sa. The safety bars 53*a* and 53*b* extend in the axial direction of the ink collecting cylinder 25 and lie between the paired right and left main frames 23. The safety bars 53*a* and 53*b* are supported slightly movably in a direction perpendicular to the cylinder shafts of the ink collecting cylinder 25 and the chablon rollers 27*d* and 27*e*. Upon interference with other objects, the safety bars 53*a* and 53*b* move and thereby a signal to stop the rotation of the main unit is transmitted.

Also, in FIG. 4, 50*a* and 50*b* represent some of packing sheets (packing members) provided respectively to the blankets 26*a* to 26*d*, specifically, packing sheets that correspond to the blankets 26*a* and 26*b*. Bars 51 are attached to the leading edges of the packing sheets 50*a* to 50*d*, respectively, and are made detachably attachable to packing sheet holding means 52 in the respective notches (gaps) 33*a* to 33*d*. The trailing edges of the packing sheets 50*a* to 50*d* are free ends entering the respective gaps 33*a* to 33*d*.

As shown in FIG. 3, on a cover 54 attached to the work-side main frame 23, there are provided a main-unit reverse inching switch 55*a*, a main-unit adjusting switch 55*b*, and a main-unit inching switch 55*c* each given a lamp. These switches 55*a* to 55*c* are located on a lateral side of the work space Sa and subjected to switch operations at the time of maintenance such as cleaning work for the ink collecting cylinder 25 or replacement work for the blankets.

A switch operation of the main-unit reverse inching switch 55*a* causes the machine to perform a reverse inching operation (in which each cylinder and the like rotate by a predetermined angle in a direction opposite to the sheet transport direction and stop). A switch operation of the main-unit inching switch 55*c* causes the machine to perform an inching operation (in which each cylinder and the like rotate by a predetermined angle in the sheet transport direction and stop). A switch operation of the main-unit adjusting switch 55*b* enables the reverse inching and inching of the machine by the switch operations of the main-unit reverse inching switch 55*a* and the main-unit inching switch 55*c*.

In the intaglio printing press as described above, sheets W fed out individually from the sheet feeding apparatus 10 onto the feeder board 11 pass through the swing arm shaft pregripper 12 and the transfer cylinders 22*a* and 22*b*. Then, the gripping of the sheet W is changed to the gripping by the grippers of the impression cylinder 21, and thereafter the sheet W is transported. Meanwhile, the inks of the inking devices 28*a* to 28*e* are transferred onto the ink collecting cylinder 25 through the chablon rollers 27*a* to 27*e* and then fed on surfaces of the intaglio printing plates of the plate cylinder 24. Excess portions of the inks are removed by the wiping roller 30. Then, the sheet W passes between the impression cylinder 21 and the plate cylinder 24 and the inks are hence transferred and printed onto the sheet W. Thereafter, the sheet W is transported by the sheet discharging chain 42 of the sheet discharging apparatus 40 through the sheet discharging cylinder 41 and discharged on a predetermined one of the delivery piles 43*a* to 43*c*.

In the first example, at the time of performing maintenance such as cleaning work for the ink collecting cylinder 25 or replacement work for the blankets 26*a* to 26*d* on the ink collecting cylinder 25, one can access to the ink collecting cylinder 25 from the work space Sa formed between the chablon roller 27*e* located at the highest position and the chablon roller 27*d* immediately below the chablon roller 27*e*, through the space Sb formed by moving the inker frame 29 backward (by separating the inker frame 29 from the chablon roller support of the main frames 23), without having to attach and detach the chablon rollers 27*a* to 27*e*. Accordingly, maintenance work for the ink collecting cylinder 25 can be performed easily.

Specifically, after placing the inker frame 29 at the separated position shown in FIG. 2, the operator M lifts the step 32 in the stored position to the work position. From the top of the step 32, the operator M performs switch operations on switches such as the main-unit reverse inching switch 55*a*, the main-unit adjusting switch 55*b*, and/or the main-unit inching switch 55*c* to perform inching and/or reverse inching of the ink collecting cylinder 25. In this way, the operator M can clean the blankets 26*a* to 26*d* on the ink collecting cylinder 25 through the work space Sa. In addition, the operator M can perform replacement work for the blankets 26*a* to 26*d* on the ink collecting cylinder 25 through the work space Sa by: the above-described rotating operation of the leading edge winding shaft 34*a* and the trailing edge winding shaft 34*b* via the worm gears 38 by operating the operation portions 62*a* and 62*b* using a tool such a spanner; attaching and detaching operations of the blankets 26*a* to 26*d* by the blanket holding means 36*a* and 36*b* with respect to the leading edge winding shaft 34*a* and the trailing edge winding shaft 34*b*; and switch operations of the main-unit reverse inching switch 55*a*, the main-unit adjusting switch 55*b*, and the main-unit inching switch 55*c*.

As a result, maintenance work takes a shorter period of time, which in turn reduces the load on the operator. Further, since the down time of the line is reduced, a decrease in productivity can be suppressed. Furthermore, since a simple machine structure can be achieved by changing the arrangement of the chablon rollers 27*a* and 27*e*, a cost reduction is possible.

Also, in the first example, unlike what is disclosed in Patent Literature 1, any of the chablon rollers 27*a* to 27*e* does not have to be detached and reattached (moved) to the inker frame 29. This brings about an advantage that when performing maintenance for the above-described ink collecting cylinder 25 for example, the operator M can also perform maintenance for the inking devices 28*a* to 28*e* supported by the inker frame 29, by turning around within the space Sb.

In addition, in the first example, the above-described work space Sa is formed between the chablon roller 27*e* located at the highest position and the chablon roller 27*d* immediately below the chablon roller 27*e*. This brings about an advantage that the arrangement (layout) of ink rollers of all the inking devices 28*a* to 28*e* on the inker frame 29 can be made the same. Specifically, if the chablon roller 27*e* located at the highest position and the chablon roller 27*d* immediately below the chablon roller 27*e* have a smaller interval therebetween, there occur conflicts with fountains and the like, which in turn requires a large diameter for the ink roller of the inking device 28*e* that corresponds to the chablon roller 27*e* located at the highest position, or some other countermeasure. However, as such is not needed in the case of the first example.

Second Example

Figure 5:
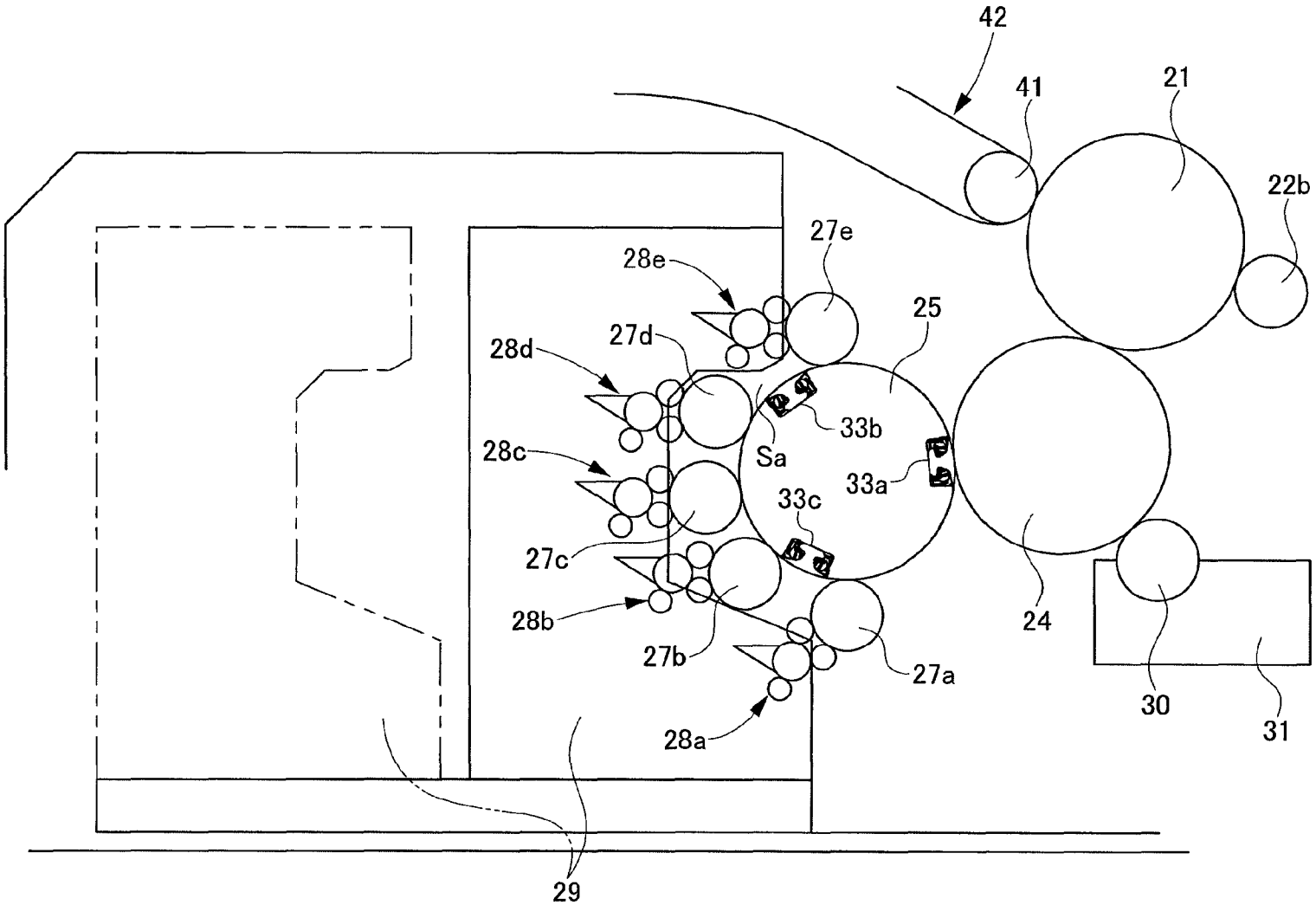
FIG. 5 is an enlarged view of a main part of a printing apparatus of a second example of the present invention.

FIG. 5 is an enlarged view of a main part of a printing apparatus showing a second example of the present invention.

The second example applies the present invention to an intaglio printing press including a triple-size cylinder, which is the ink collecting cylinder 25 of the first example including three gaps 33*a* to 33*c* at an equal interval in the circumferential direction. The only difference from the first example in configuration is the diameter ratio of the ink collecting cylinder 25 to the intaglio cylinder 24. The second example is the same as the first example in that the five chablon rollers 27*a* to 27*e* are in contact with the ink collecting cylinder 25, and that the work space Sa is formed between the chablon roller 27*e*, which is located at the highest position among the five chablon rollers 27*a* to 27*e*, and the chablon roller 27*d* immediately below the chablon roller 27*e*. The second example can also bring about the same advantageous effects as the first example.

Third Example

Figure 6:
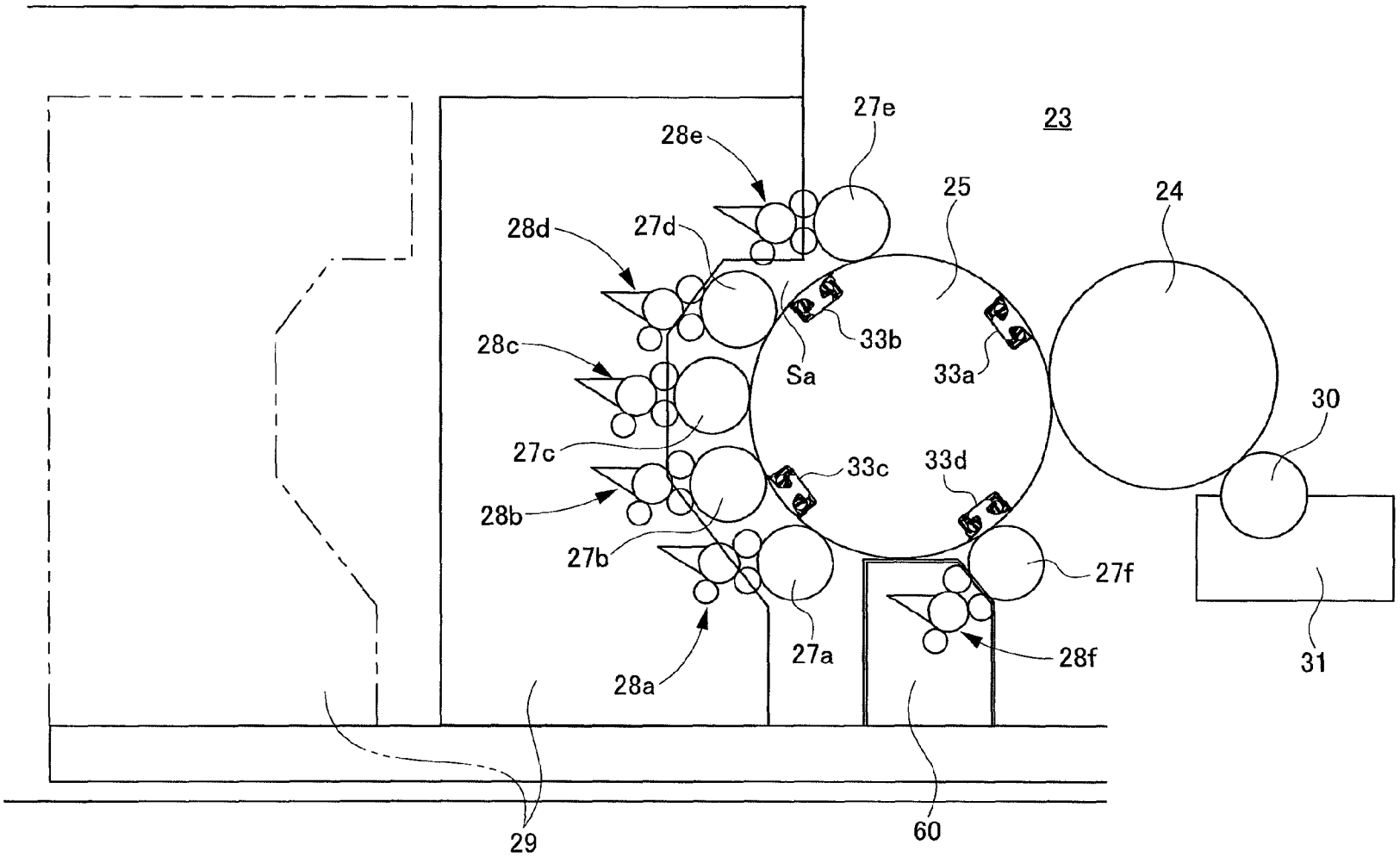
FIG. 6 is an enlarged view of a main part of a printing apparatus of a third example of the present invention.

FIG. 6 is an enlarged view of a main part of a printing apparatus showing a third example of the present invention.

The third example applies the present invention to an intaglio printing press of six colors obtained by adding a chablon roller 27*f* and an inking device 28*f* of another color to the chablon rollers 27*a* to 27*e* and the inking devices 28*a* to 28*e* of the first example. The location of the work space Sa is the same as the first example. The third example can also bring about the same advantageous effects as the first example. Note that in this case, the chablon roller 27*f* thus added is supported by the main frames 23 similarly to the other chablon rollers 27*a* to 27*e*, whereas the inking device 28*f* is supported by an inker frame 60 which can be drawn laterally (in the lateral direction), i.e., in the axial direction of the ink collecting cylinder 25.

Fourth Example

Figure 7:
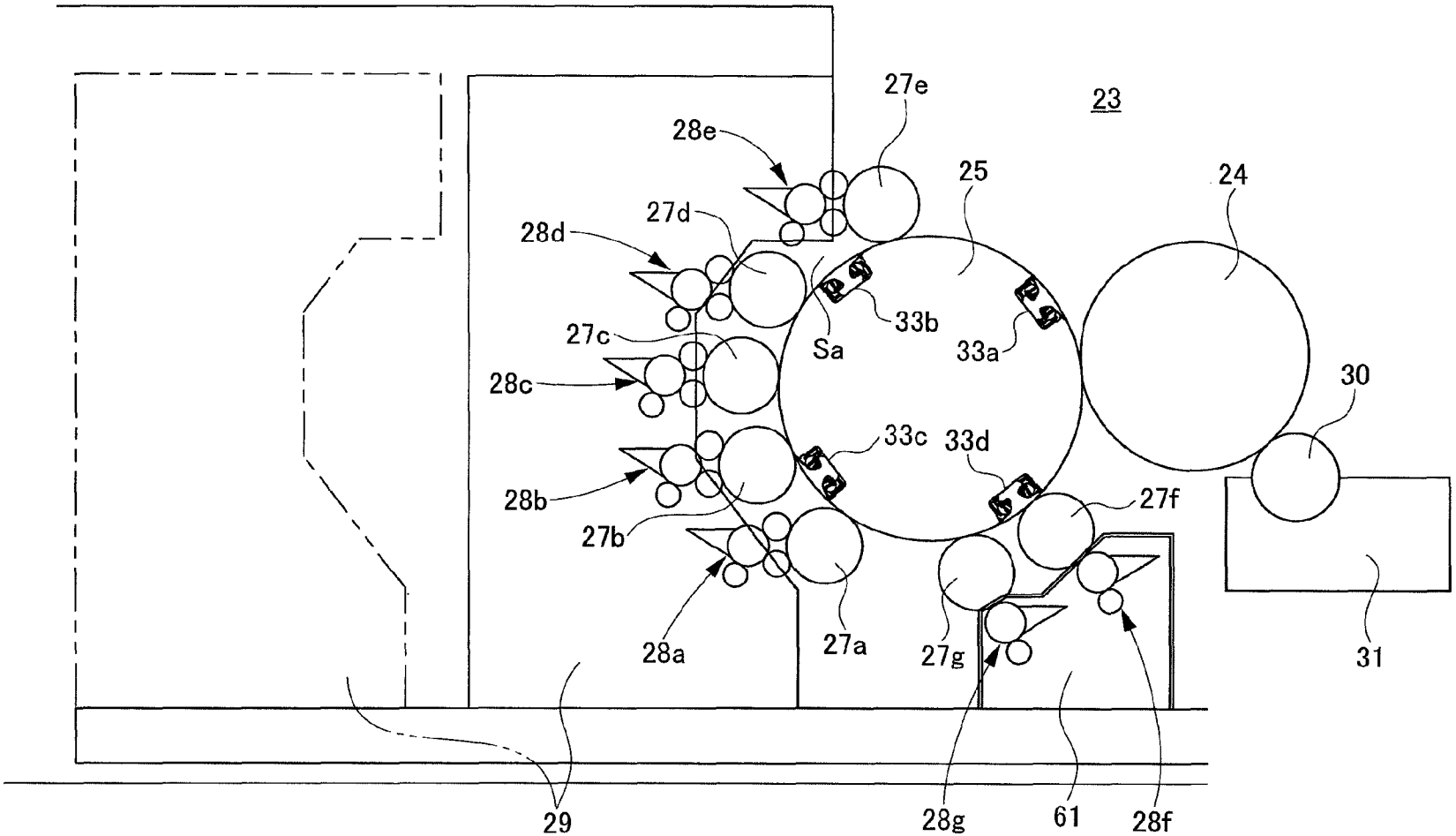
FIG. 7 is an enlarged view of a main part of a printing apparatus of a fourth example of the present invention.

FIG. 7 is an enlarged view of a main part of a printing apparatus showing a fourth example of the present invention.

The fourth example applies the present invention to an intaglio printing press of seven colors obtained by adding chablon rollers 27*f* and 27*g* and inking devices 28*f* and 28*g* of two other colors to the chablon rollers 27*a* to 27*e* and the inking devices 28*a* to 28*e* of the first example. The location of the work space Sa is the same as the first example. The fourth example can also bring about the same advantageous effects as the first example. Note that in this case, the chablon rollers 27*f* and 27*g* thus added are supported by the main frames 23 similarly to the other chablon rollers 27*a* to 27*e*, whereas the inking devices 28*f* and 28*g* are supported collectively by an inker frame 61 which can be drawn laterally (in the lateral direction), i.e., in the axial direction of the ink collecting cylinder 25.

It is needless to say that the present invention is not limited to the above-described examples, and various medications can be made without departing from the scope of the present invention. For example, the work space Sa may be formed between any other two adjacent chablon rollers. Also, the number of work spaces Sa is not limited to one. Moreover, each of the above-described examples has been described based on an intaglio printing press of five or more colors, i.e., an intaglio printing press including five or more chablon rollers 27*a* to 27*g* and five or more inking devices 28*a* to 28*g*. However, the present invention may be applied to an intaglio printing press of four colors, i.e., an intaglio printing press including four chablon rollers 27*a* to 27*d* and four inking devices 28*a* to 28*d*.

INDUSTRIAL APPLICABILITY

An intaglio printing press according to the present invention is suitable when used for a sheet-fed offset printing press for printing banknotes, securities, and the like.

REFERENCE SIGNS LIST

10 SHEET FEEDING APPARATUS
20 PRINTING APPARATUS
21 IMPRESSION CYLINDER
23 MAIN FRAME
24 PLATE CYLINDER
25 INK COLLECTING CYLINDER
26*a* to 26*d* BLANKET
27*a* to 27*g* CHABLON ROLLER
28*a* to 28*g* INKING DEVICE
29, 60, 61 INKER FRAME
30 WIPING ROLLER
32 STEP
33*a* to 33*d* GAP
34*a* LEADING EDGE WINDING SHAFT
34*b* TRAILING EDGE WINDING SHAFT
38 WORM GEAR
40 SHEET DISCHARGING APPARATUS
53*a*, 53*b* SAFETY BAR
54 COVER
55*a* MAIN-UNIT REVERSE INCHING SWITCH
55*b* MAIN-UNIT ADJUSTING SWITCH
55*c* MAIN-UNIT INCHING SWITCH
M OPERATOR
W SHEET
Sa WORK SPACE
Sb SPACE

The invention claimed is:

1. An intaglio printing press comprising:

an intaglio cylinder;

a collecting cylinder which has a blanket attached to a circumferential surface of the collecting cylinder, is in contact with the intaglio cylinder, and transfers ink onto the intaglio cylinder;

a plurality of rotating parts which are in contact with the collecting cylinder and transfer ink onto the collecting cylinder;

an ink feeding unit which feeds ink to the rotating parts, a first frame which rotatably supports the collecting cylinder and all of the rotating parts;

a second frame which supports the ink feeding unit, is supported movably, and allows the ink feeding unit to move in approaching and separating directions with respect to the rotating parts, and a blanket holding unit, provided in a notch formed in the collecting cylinder, that holds the blanket, wherein the plurality of rotating parts are arranged in such a manner that a work space is formed between adjacent ones of the rotating parts, and the work space is exposed, when the second frame is moved in the separating direction, allowing an access to the collecting cylinder without attachment and detachment of the rotating parts during maintenance including work for the collecting cylinder and replacement work for the blanket, wherein the collecting cylinder is a quadruple-size cylinder, and the blanket holding unit is accessible from the work space, wherein the access to the collecting cylinder is allowed through the work space from a space formed between the ink feeding unit and the rotating parts, wherein the plurality of rotating parts includes at least five rotating parts, wherein a liftable step is placed in the space, the liftable step being configured to be movable to a stored position when the second frame is located close to the first frame and to a work position when the second frame is placed away from the first frame, and wherein, in the work space, a safety bar is provided which is located near a point where the collecting cylinder and any of the rotating parts is in contact with each other, and which extends in an axial direction of the collecting cylinder, the safety bar being configured to stop operation of the intaglio printing press when moved by an object, a main-unit inching switch, a main-unit reverse inching switch, and a main-unit adjusting switch are provided on a main-unit frame located at a lateral side of the work space, the main-unit adjusting switch allowing switch operations of the main-unit inching switch and the main-unit reverse inching switch, the switches being provided at a position reachable by an operator standing on the liftable step.

2. The intaglio printing press according to claim 1, wherein one of the adjacent rotating parts forming the work space is located at a position that is higher than the other rotating parts.

3. The intaglio printing press according to claim 2, wherein the rotating parts are arranged in such a manner that an interval between the highest rotating part and the rotating part immediately below the highest rotating part is larger than an interval between other adjacent ones of the rotating parts.

* * * * *